United States Patent [19]

Anderson et al.

[11] Patent Number: 4,832,302

[45] Date of Patent: May 23, 1989

[54] GUITAR MOUNTED MUSIC HOLDER

[76] Inventors: Yohann Anderson, P.O. Box 7; Merritt A. Robinson, 475 Fawn Dr., both of Anselmo, Calif. 94960

[21] Appl. No.: 170,855

[22] Filed: Mar. 21, 1988

[51] Int. Cl.[4] ..... G10G 5/00

[52] U.S. Cl. ..... 248/443; 248/444

[58] Field of Search ..... 248/443, 460, 441, 445, 248/444

[56] References Cited

U.S. PATENT DOCUMENTS

| | | | |
|---|---|---|---|
| 487,820 | 12/1892 | Benson | 248/443 |
| 608,438 | 8/1898 | Bye | 248/443 |
| 857,504 | 6/1907 | Waldteufel | 248/443 |
| 2,540,928 | 2/1951 | Briggs | 248/443 |
| 3,463,438 | 8/1969 | Olson | 248/444 |
| 3,544,056 | 12/1970 | Berquist | 248/443 |
| 3,946,980 | 3/1976 | Tamarkin | 248/443 |
| 3,948,476 | 4/1976 | Kuniyosi | 248/443 |
| 4,326,691 | 4/1982 | Lloyd | 248/447.2 X |
| 4,501,403 | 2/1985 | Goodrich | 248/443 |

*Primary Examiner*—Ramon O. Ramirez
*Attorney, Agent, or Firm*—Larry D. Johnson

[57] ABSTRACT

A guitar mounted music holder provides an adjustable support device to hold and display sheet music or other material adjacent an acoustic-type guitar or other musical instrument. The music holder comprises a bracket member having a plate portion with a first edge conditioned for placement against the lower edge of the fret board of the guitar neck, and a hook element to securely clasp to the rim of the guitar body sound hole. The bracket member also includes an arm portion extending generally outward and away from said plate portion remote from said plate portion first edge, and an adjustable strap portion conditioned to extend from the bracket member to a peg or other attachment point on the guitar body. The music holder further includes an easel member which connects to the arm portion of the bracket member so that sheet music or other material can be placed beneath a clip on the easel and visually displayed to the guitar player.

4 Claims, 1 Drawing Sheet

FIG._1.
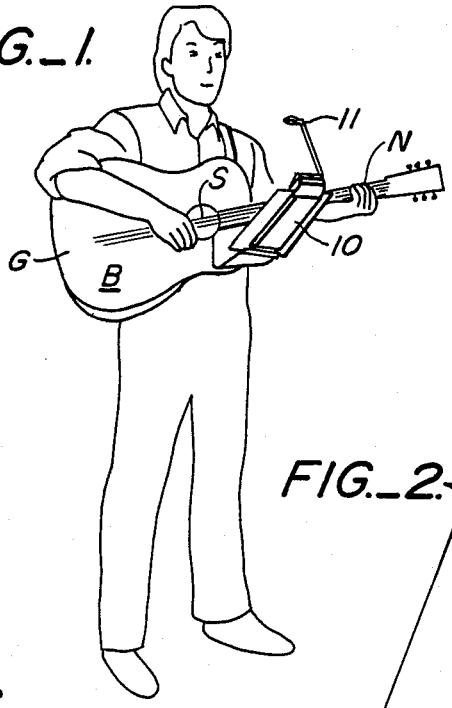
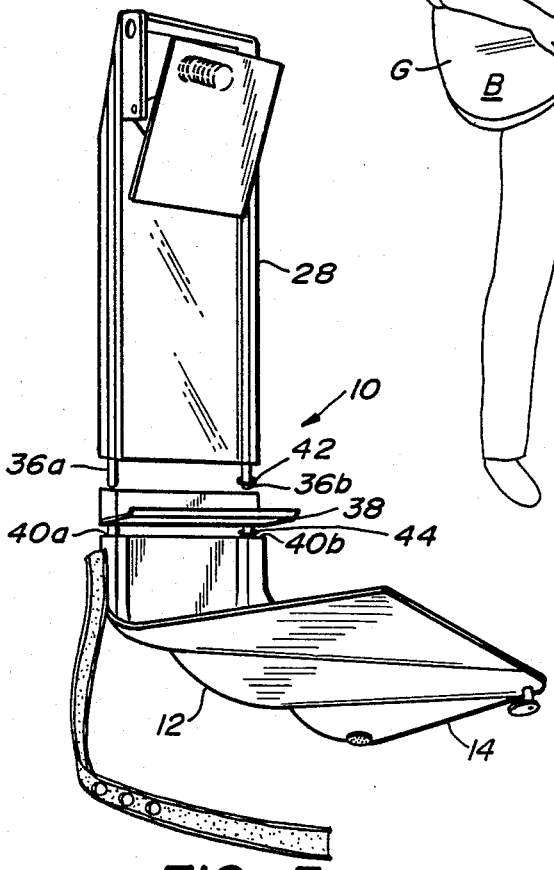
FIG._3.
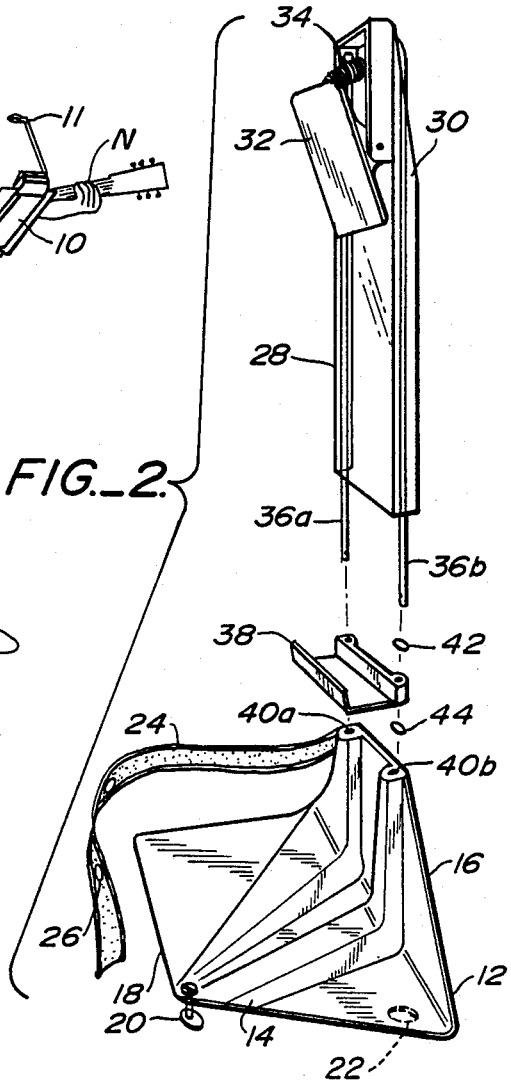
FIG._2.
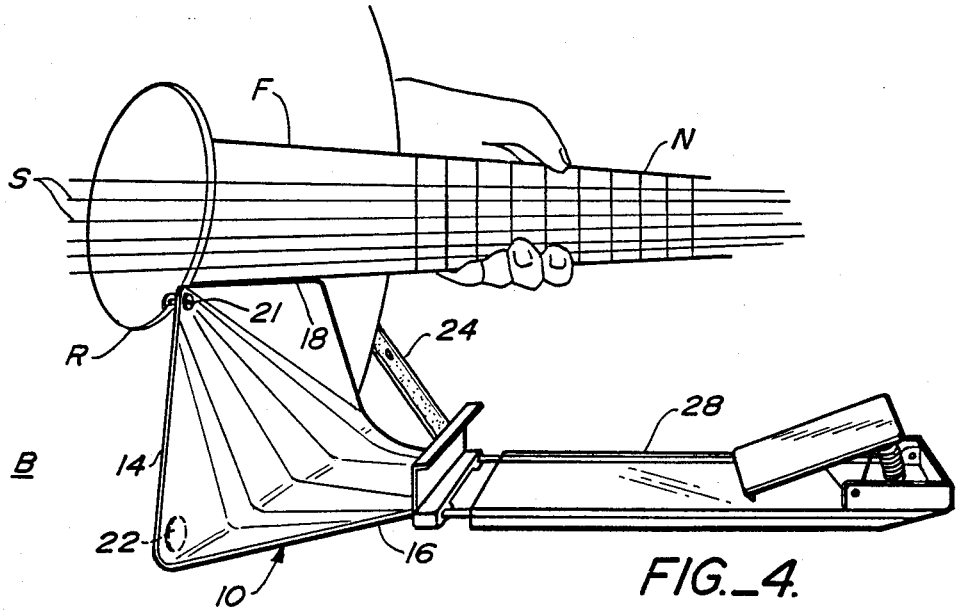
FIG._4.

GUITAR MOUNTED MUSIC HOLDER

BACKGROUND OF THE INVENTION

1. Field of the Invention

This invention relates generally to musical instruments and related accessories, and more specifically to an improved apparatus for holding and displaying sheet music or other material adjacent to a musical instrument.

2. Description of the Prior Art

Music stands and other devices for supporting and displaying sheet music are well known. For example, most musical bands and orchestras use traditional, floor-mounted music stands for each of their performers. Smaller, instrument-mounted devices have been developed for use with many portable instruments, such as the clip-type holders attached to the instruments carried in a marching band.

However, guitars and other hollow-bodied acoustic instruments have presented special problems in the design of an appropriate music holder. First, the holder should attach to the guitar or other instrument in a manner that does not affect the sound quality of the instrument. Next, the holder should be located so as to not interfere with the player's hand and arm movements necessary to play the guitar. Furthermore, the music holder should position and display the sheet music in an efficient and desirable location for the guitar player. Still further, the music holder should be able to accommodate sheet music or books of various weights and dimensions. In addition, the music holder must be particularly light in weight, so as not to be unduly cumbersome to the player, or affect the balance of the guitar. Finally, the music holder should be easily mountable to and removable from the guitar, so that it can be readily removed when not required, and thus not interfere with the placement of the guitar in its storage case for transportation.

SUMMARY OF THE INVENTION

The guitar mounted music holder of this invention provides an adjustable support device to hold and display sheet music or other material adjacent an acoustic-type guitar or other musical instrument having a body with a front surface or face, a sound hole in the body, and a neck extending from the body. The music holder comprises a bracket member having a generally planar plate portion with a first edge conditioned for placement against the lower edge of the fret board of the guitar neck, and a hook element to securely clasp to the rim of the guitar body sound hole, so that the bracket plate portion is substantially flush with the guitar face. The bracket member also includes an arm portion extending generally outward and away from said plate portion remote from said plate portion first edge, and adjacent the lower edge of the guitar body, and an adjustable strap portion conditioned to extend from the bracket member to a peg or other attachment point on the guitar body. Thus, when the hook element is engaged into the sound hole, the bracket member first edge is abutting the fret board, and the strap portion is attached to a peg on the guitar body, the plate portion of the bracket member is secured in place against the face of guitar body.

The music holder further includes an easel member which connects to the arm portion of the bracket member so that sheet music or other material can be placed beneath a clip on the easel and visually displayed to the guitar player. Because of the flush arrangement of the bracket member plate portion against the guitar face, the weight of the sheet music (and music holder) is borne by the face and edge of the guitar body, rather than by the rim of the sound hole. Thus, the sound hole is not distorted, nor is the guitar sound quality affected in any way. In addition, because the bracket member arm portion and the easel member extend outwardly away from the guitar body adjacent its lower edge, the sheet music is located in an ideal position for viewing by the guitar player, but yet does not interfere with the player's hand and arm movements.

In the preferred embodiment, the easel member includes an adjustable clip and shelf portion enabling support of various sizes of materials, and a transparent clip portion so that even the material beneath the clip can be viewed. A further option provides a small, retractable light or lamp to enable music reading in low-light conditions. The easel member is readily removable from the bracket member, and the bracket member from the guitar, so that the entire assembly can be disassembled for storage and transportation.

BRIEF DESCRIPTION OF THE DRAWINGS

FIG. 1 is a perspective view of a guitar-mounted music holder of this invention in place and in use on a typical acoustic guitar;

FIG. 2 is an exploded perspective view of a guitar-mounted music holder of this invention, illustrating the preassembly relationship of the various components;

FIG. 3 is a perspective view of an assembled guitar-mounted music holder of this invention; and FIG. 4 is a partially cutaway perspective view of an assembled guitar-mounted music holder mounted and secured in place on an acoustic guitar.

DETAILED DESCRIPTION OF A PREFERRED EMBODIMENT

FIG. 1 is a perspective view of a guitar-mounted music holder 10 in place and in use on a typical acoustic guitar G. Guitar G includes a guitar body B, a sound hole S in the body, and a neck N extending from the body. Fret board F is on the front of neck N, and extends onto the body of the guitar itself. FIG. 1 also illustrates an optional light device 11, so that the music holder is usable in low-light conditions.

FIG. 2 is an exploded perspective view of a guitar-mounted music holder 10. Music holder 10 includes bracket member 12 having a plate portion 14 and an arm portion 16. Plate portion 14 includes a first edge 18, with a catch or hook element 20 located near one end thereof. A plurality of rubber pads 22 may be incorporated onto the back of plate portion 14, to prevent scratching of the guitar surface (described infra). Adjustment strap portion 24 attaches to bracket 12, as, for example, near the upper end of arm portion 16. Strap 24 includes a plurality of holes 26 for attachment to a peg on the guitar body.

Easel member 28 includes a generally rigid back portion 30, with a clip portion 32 and spring 34 to enable placement and retention of sheet music or other material on the easel. A pair of easel rods 36*a, b* extend from the base of the back portion down through a shelf or ledge 38 and into receiving holes 40*a, b* located in the upper end of arm portion 16. Upper O-ring 42 and lower O-ring 44 enable up-and-down adjustment and positioning of the easel back portion relative to the shelf 38, and the shelf relative to the arm portion 16, respectively. In addition, lower O-ring 44 serves to prevent the shelf from falling off of the easel rods when the music holder is disassembled.

FIG. 3 is a perspective view of an assembled guitar-mounted music holder 10. In this view, easel rods 36*a, b* can be seen to completely penetrate shelf 38 and engage arm portion 16 via receiving holes 40*a, b*. Rods 36*a, b* are preferably releasably retained in the arm portion by a notch engagement, frictional engagement, or some other mechanical means, so that the rods, and thus the easel member 28, are securely retained in place, and do not inadvertently fall out of the bracket. This view also illustrates the easel back nearly fully positioned against the bracket 12, which would be appropriate for holding a relatively small size (e.g., pocket-size books) of sheet music. Larger sheets (e.g., twelve inches) can be accommodated by appropriate adjustment of the easel back away from the bracket, and proper positioning of the O-rings 42, 44 and shelf 38.

FIG. 4 is a partially cutaway perspective view of an assembled guitar-mounted music holder 10 mounted and secured in place on an acoustic guitar G. Plate portion first edge 18 is abutted against the lower edge of guitar fret board F. Hook element 20 is inserted around and captures sound hole rim R, and is tightened there by a screw 21 (enabling attachment of the hook element to various rim thicknesses). Thus, the plate portion 14 lies substantially flush to the face of the guitar body B, but the two are effectively prevented from scratching against one another by the rubber pad 22. An added benefit of this arrangement is that the plate portion acts as a shield (pick guard) for the guitar surface.

Adjustable strap portion 24 extends from arm portion 16 to a guitar strap peg (not visible) on the base of the guitar neck, or other attachment means on the body of the guitar. Placement of this strap portion effectively stabilizes the music holder, and enables support of even relatively bulky sheet music or other materials.

In the preferred embodiment, the bracket member and easel member of the music holder are made of clear plastic or other suitable material, yielding a weight of only approximately eight ounces. The respective member disassemble, as illustrated, and easily fit within most standard guitar cases for transport.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A music holder for guitars having a body with a front surface, a sound hole in the body, said sound hole having a rim, and a neck extending from the body, said neck having a fret board on said body, said music holder comprising:

a bracket member having a generally planar plate portion with a first edge conditioned for placement against said guitar neck fret board adjacent said guitar sound hole, a hook element adjacent said first edge, said hook element conditioned to grasp said rim, and an arm portion extending generally outward and away from said plate portion;

strap means for securing said bracket member to said guitar body; and an easel member connected to said bracket member arm portion, said easel member including clip means for holding and displaying said music, and further including adjustment means for accommodating different sizes of music.

2. The music holder of claim 1 wherein said adjustment means comprises an easel back portion slidably mounted on at least one easel rod member, said rod conditioned for engagement with said bracket member arm portion.

3. The music holder of claim 2 wherein said rod member is releasably engaged with said bracket member arm portion.

4. The music holder of claim 3 wherein said guitar body includes a peg member, and said strap means comprises an adjustable strap portion for releasable engagement with said peg member.

* * * * *